United States Patent [19]

Nieuwenhuis et al.

[11] 4,230,969

[45] Oct. 28, 1980

[54] IGNITION TIMING TESTING DEVICE

[75] Inventors: Mogens D. Nieuwenhuis, Amsterdam; Raymond Van Bracht, Veld, both of Netherlands

[73] Assignee: Aquapro A.G., Switzerland

[21] Appl. No.: 45,737

[22] Filed: Jun. 5, 1979

[30] Foreign Application Priority Data

Jun. 5, 1978 [NL] Netherlands ..... 7806096

[51] Int. Cl.[3] ..... H05B 41/34

[52] U.S. Cl. ..... 315/241 S; 315/34; 324/391; 324/402; 343/711; 343/720

[58] Field of Search ..... 315/241 S, 34; 362/154, 362/155; 324/379, 391, 402; 343/701, 711, 720, 721

[56] References Cited

U.S. PATENT DOCUMENTS 3,286,165 11/1966 Small ..... 324/391

3,497,798 2/1970 Schick ..... 324/53

3,793,585 2/1974 Glomski et al. ..... 324/402

*Primary Examiner*—Eugene R. LaRoche

*Attorney, Agent, or Firm*—Kane, Dalsimer, Kane, Sullivan and Kurucz

[57] ABSTRACT

Device for stroboscopically testing the ignition timing of an internal-combustion motor, comprising a flat elongate casing and a flash lamp and a trigger circuit for the flash lamp arranged in the casing, which trigger circuit is adapted to be controlled by impulses received from the ignition system of the motor to be tested, the casing comprising three parts, a middle casing part containing the flash lamp trigger circuit and, at its forward end, mounting means for the flash lamp, a front casing part forming a removable lens cap having a lens mounted in an opening in front of the flash lamp, and a hollow rear casing part provided on its inner wall with a flat metal antenna member operatively connected to the trigger circuit.

7 Claims, 3 Drawing Figures

IGNITION TIMING TESTING DEVICE

BACKGROUND OF THE INVENTION

The invention relates to a device for stroboscopically testing the ignition timing of an internal-combustion motor.

Such devices are well known in the art and generally comprise a flash lamp of the ionised-gas type having a triggering electrode to which the triggering voltage of a suitable trigger circuit is applied, which trigger circuit is adapted to be controlled by impulses received from the ignition system of the motor to be tested. The flashes of the flashlamp are used to stroboscopically illuminate a rotating part of the motor to be tested, generally a test mark provided for that purpose on the flywheel of the motor.

In the conventional devices of this kind the impulses controlling the trigger circuit are supplied to this circuit through a test lead having a connector for the galvanic or inductive connection to the spark plug or spark plug cable of the first cylinder of the motor (see for instance the U.S. Pat. No. 3,497,798) or to the primary winding of the ignition coil of the ignition system of the motor (see the British Pat. No. 684,791), which is however unpractical. The known devices are usually provided with a conventional xenon-filled flash lamp having lead wires projecting from the envelope of the lamp which must be connected by soldering so that this flash lamp cannot be exchanged by the user himself. Finally, the devices of the prior art have generally such thickness dimensions that, in many conventional motors, they cannot be properly inserted into the restricted space between the flywheel and the ventilator of the motor for properly illuminating the test mark on the flywheel for stroboscopic observations.

SUMMARY OF THE INVENTION

The present invention has for its object to provide an improved device of the above-mentioned kind which obviates the disadvantages of the conventional prior art devices.

More particularly, is an object of the present invention to provide such a device which has no need for a test lead to be connected to a part of the ignition system of the motor to be tested.

Another object of the invention is to provide such a device which is easy to handle and which allows a proper illumination and observation of the test mark on the motor flywheel also in difficult circumstances.

With these objects in view, according to the invention the device of the indicated kind has a casing of flat elongate shape and comprising three parts, a middle casing part containing the flash lamp trigger circuit and, at its forward end, comprising means for exchangeably mounting the flash lamp, such as a xenon-filled lamp, a front casing part forming a removable lens cap having a lens mounted in an opening in front of the flash lamp, and a hollow rear casing part provided on its inner wall with a flat metal antenna member operatively connected to the trigger circuit.

The antenna member in the rear housing may consist of a metal plate shaped to fit against the inner wall of this casing part or may consist of a metal coating provided on the inner wall of this casing part. This antenna member receives the electro-magnetic waves generated by the firing impulses for the several spark plugs of the motor which impulses control the flash lamp trigger circuit of the device. This means that the firing impulses of each cylinder of the motor provoke the flashing of the flash lamp and not just the firing impulses of the first motor cylinder. When using the device, it is thus not necessary to first determine which of the motor cylinders is the first one, which is sometimes difficult to find out. Depending on the motor type, a number of flashes will not contribute to the stroboscopic image of the test mark on the flywheel but a number of other flashes derived from different cylinders will contribute to such image. In a four-cylinder motor, for instance, the flashes derived from two cylinders will each time illuminate the test mark whereby this test mark can be seen with greater clarity. An additional advantage is that in this manner it can also be determined whether or not the shaft of the distributor of the motor under test is bent or worn or the cam disc of the distributor has been subjected to irregular wear. In that case, the stroboscopic image of the two image-forming flashes will not show a single test mark but two separate spaced test marks on the flywheel.

By the arrangement of the antenna in a separate rear casing part away from the trigger circuit in the middle casing part a possible back coupling is avoided.

The life of the flash lamp is, of course, considerably shorter than the life of the other parts of the device. This is particularly the case with the device according to the present invention since this device generates a considerably greater number of flashes per unit of time. It is, therefore, of importance that the flash lamp should be easily replaceable. To that purpose, the device of the invention has preferably a flash lamp of tubular form with terminal pins axially projecting from its two ends and with a metal trigger electrode formed about the tube, the flash lamp mounting means in the middle casing part of the device comprising three connector clips for receiving and holding the two terminal pins and the trigger electrode of the flash lamp. In this manner solder connections for the flash lamp are avoided and the user can himself replace a defective flash lamp upon removal of the lens cap without the need to send the device to the supplier for repair as is generally the case with the conventional devices of the present type.

Because of the flat elongate shape of its casing the device can be easily inserted into the space between the flywheel and the ventilator of the motor to be tested, also if this space is restricted.

The use of the device of the invention is very simple because it suffices to connect the device by means of power input leads to a power source, such as the motor battery, to start the motor and to switch-on the trigger circuit, for instance by actuating a push button switch provided for that purpose.

BRIEF DESCRIPTION OF THE DRAWINGS

The drawings show a preferred embodiment of the device according to the invention.

DESCRIPTION OF A PREFERRED EMBODIMENT OF THE INVENTION

Figure 1:
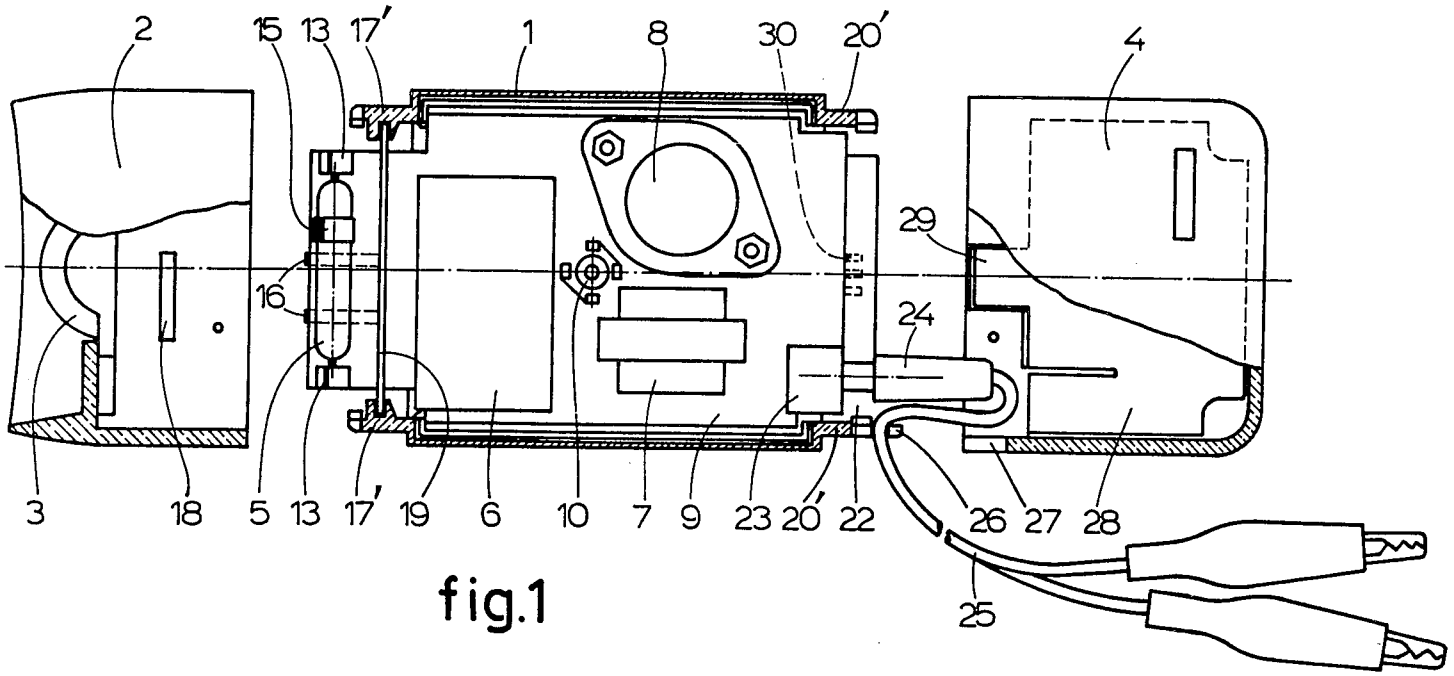
FIG. 1 is a top view of the device in which the upper half of the middle casing part has been removed and the walls of the front and rear casing parts have been partly cut away, these latter casing parts being shown detached from the middle casing part.

Referring to the drawings, the device there shown has a casing of flat, elongate shape and comprising three casing parts 1, 2 and 4 detachably secured to each other. The casing thus has a middle casing part 1 formed from two shell-like members fixedly secured upon each other, a front casing part forming a lens cap 2 with a lens 3 mounted in a front opening of this cap, and a rear casing part or end cap 4. The middle casing part 1 contains a trigger circuit for a xenon-filled tube-shaped flash lamp 5. The trigger circuit is of a design well known in the art and therefore not described in detail. This circuit comprises in a conventional manner a condenser 6, a transformer 7 and a power transistor 8 which elements are mounted on a printed circuit board 9. The circuit means are so dimensioned and arranged that they can be received in a casing part 1 of the desired flat shape. Thus, the height of the casing part 1 of the embodiment shown is not greater than 25 mm and the width of this casing part 1 approximately 60 mm. A push button switch 10 is mounted on the board 9 and has a push button 11 arranged countersunk in an opening in the upper wall of the casing part 1. By pressing this push button 11 inwardly against the action of a spring, the switch 10 can be actuated to energize the trigger circuit.

Figure 2:
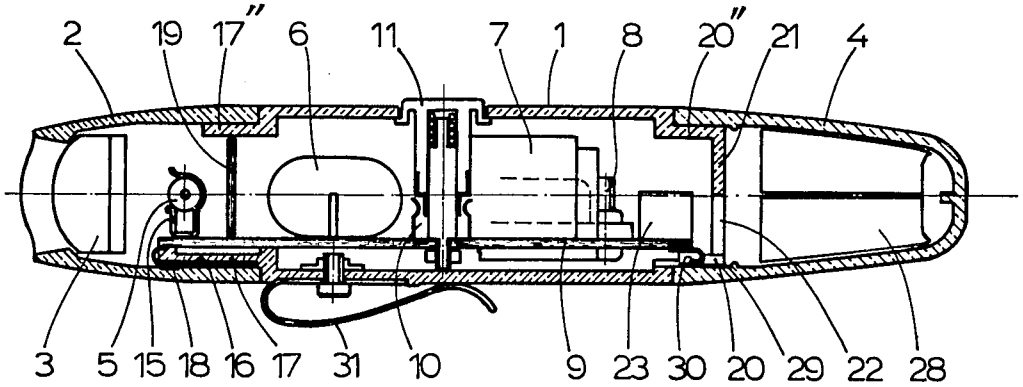
FIG. 2 shows a vertical longitudinal section of the device in the assembled position.
Figure 3:
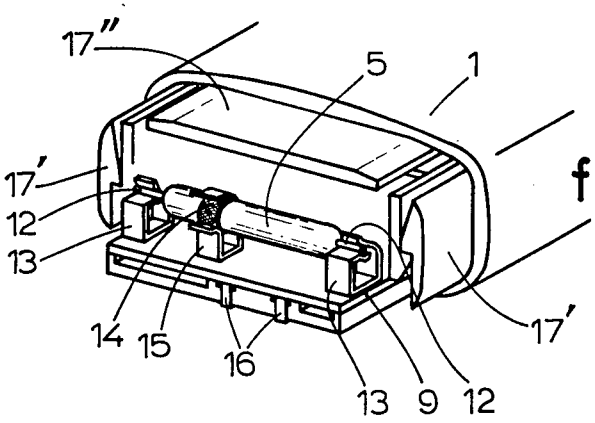
FIG. 3 is a perspective view of the front part of the device after the removal of the lens cap.

The xenon-filled flash lamp 5 is supported on a projecting portion of the board 9 at the front side of the casing part 1 and has a tubular form with terminal pins 12 projecting axially from both ends of the tubular envelope of the lamp. The lamp 5 is removably mounted with its terminal pins 12 in two connector clips 13 fixedly secured on the projecting portion of the board 9. The tubular envelope of the flash lamp 5 is provided on its outer side with an annular band-shaped metal trigger electrode 14 which makes contact with a further connector clamp 15 in the mounted position of the lamp. After removal of the cap 2 the flash lamp 5 is thus easily accessable and exchangeable. The contacts 13 and 15 are suitably connected in the high-voltage circuit of the flash lamp trigger system by means of the printed conductors on the board 9 (not shown). This high-voltage circuit of the flash lamp 5 comprises two contact strips 16 extending along the lower outer side of an edge portion 17 of the lower wall of the casing part 1 extending forwardly underneath the flash lamp 5. As shown in FIG. 2, this edge portion 17 is offset inwardly with respect to the main wall portion of the casing part 1, as are corresponding forwardly projecting inwardly offset edge portions 17' and 17'' of the side wall and upper wall portions of the casing part 1. The lens cap 2 fits clampingly on these edge portions 17, 17', and 17'' and carries on its lower inner wall a conductive bridging strip 18 which electrically connects the two contact strips 16 so that when the lens cap 2 is mounted on the middle casing part 1, as shown in FIG. 2, the high-tension circuit of the flash lamp 5 is closed by this bridging strip 18 whereas on the removal of the lens cap 2 this circuit is opened in a manner that all tension is removed from the lamp contacts and the flash lamp 5 can be removed without any danger of shock. Instead of the contact strips 16 with bridging strip 18 it is also possible to provide a suitable contact means which is actuated by the lens cap 2 and which upon the removal of this lens cap short-circuits the condenser 6 (not shown).

A reflector plate 18 is mounted between the edge portions 17, 17', 17'' behind the flash lamp 5. FIG. 2 shows that in the mounted position of the lens cap 2 the flash lamp 5 projecting forwardly from the casing part 1 is situated close behind the lens 3 of the lens cap. A spring clip 31 is secured against the lower side of the casing part 1. The middle casing part 1 has at its rear side likewise rearwardly projecting, inwardly offset edge portions 20, 10', 20'' on which the end cap 4 can be clampingly but removably fitted. The edge portions 20 and 20'' extending along the wider upper and lower sides of the casing part 1 are connected by a rear wall 21 provided with an opening 22 giving access to a two-pole plug contact adapted to receive a corresponding plug 24 on one end of a power input cable 25 to be connected to a power supply such as the battery of the motor to be tested. This cable 25 can be clampingly held in a hook-shaped opening 26 provided in the adjacent edge portion 20', the cable passing outwardly through this opening 26 and a corresponding opening 27 in the end cap 4. When the device is not in use, the cable 25 can be stored in the hollow space inside this end cap 4.

A plate-metal antenna 28 is secured against the inner wall of the end cap 4, the plate antenna being so formed that it almost completely covers the area of this inner cap wall. The plate antenna has at one side thereof a forwardly projecting contact tongue 29 which, when the end cap 4 is placed on the casing part 1, engages a resilient antenna contact 30 mounted in an opening in the lower edge portion 20 and suitably connected to the printed circuit of the board 9.

When the device is to be used, the cable 25 stored in the end cap 4 is taken out and connected to the motor battery, the end cap 4 being again replaced. When the motor is started, the device is immediately ready for use and can be switched on by pressing the push button of the switch 10. Because of its flat shape the device can, if necessary, easily be inserted into the space between the ventilator and the flywheel of the motor so as to obtain a proper illumination of the test mark on the flywheel by the flash lamp 5 which, as above described, flashes in response to the firing impulses of each cylinder of the motor.

What is claimed is:

1. Device for stroboscopically testing the ignition timing of an internal-combustion motor, comprising a casing of flat elongate shape including a middle casing part, a rear casing part and a front casing part removably attached to said middle casing part, a flash lamp of the ionised-gas type having a triggering electrode, means for exchangeably mounting said flash lamp at the forward end of said middle casing part, trigger circuit means for said flash lamp arranged in said middle casing part, said front casing part having an opening in its forward side and a lens mounted in said opening in front of said flash lamp, and a metal antenna member mounted inside said rear casing part and operatively connected to said trigger circuit means so as to control said latter means to trigger said flash lamp in response to impulses received by said antenna means from the ignition system of the motor being tested.

2. The device of claim 1 in which said antenna member is arranged coextensive with the inner wall of said rear casing part substantially covering the surface area thereof.

3. The device of claim 1 in which said flash lamp comprises an envelope of tubular form, terminal pins axially projecting from the two ends of said envelope, and a metal trigger electrode formed about said envelope, and in which said flash lamp mounting means in said middle casing part comprise three connector clips for removably receiving and holding said two terminal pins and said trigger electrode, respectively, of said flash lamp, said middle casing part and said front casing part having cooperating contact means adapted to disconnect said flash lamp from said trigger circuit means when said front casing part is removed from said middle casing part.

4. The device of claim 3, characterized in that said cooperating contact means comprise two contact strips on said middle casing part connected in the flash lamp circuit of said trigger circuit means, and a bridging strip secured inside said front casing part and adapted to interconnect said two contact strips when said front casing part is placed on said middle casing part so as to close said flash lamp circuit and to break said circuit when the front casing part is removed.

5. The device of claim 1, in which said middle casing part supports a push button switch for energizing said trigger circuit means.

6. The device of claim 5, further comprising cooperating antenna connecting contact means on said rear casing part and said middle casing part, respectively, for connecting said antenna member to said trigger circuit means when said two casing parts are assembled.

7. The device of claim 1 further comprising power supply leads adapted to be connected to a power supply, such as the battery of the motor being tested, said rear casing part being likewise removably attached to said middle casing part and said rear casing part forming a storing space for said power supply leads when the device is not in use.

* * * * *